US006482308B1

(12) United States Patent
Wiemann

(10) Patent No.: US 6,482,308 B1
(45) Date of Patent: Nov. 19, 2002

(54) CANVAS ABRASIVE MATERIAL AND GRINDING PROCESS

(76) Inventor: Martin Wiemann, Am Hendelberg 20, D-65375 Oestrich-Winkel (DE)

( * ) Notice: Subject to any disclaimer, the term of this patent is extended or adjusted under 35 U.S.C. 154(b) by 0 days.

(21) Appl. No.: 09/400,740

(22) Filed: Sep. 21, 1999

(30) Foreign Application Priority Data

Sep. 21, 1998 (DE) ..... 198 43 266

(51) Int. Cl.[7] ..... B32B 5/02

(52) U.S. Cl. ..... 205/222; 428/149; 428/150; 428/143; 451/59; 51/294; 51/295; 51/298

(58) Field of Search ..... 428/143, 144, 428/150; 451/59; 51/294, 295, 298; 205/222

(56) References Cited

U.S. PATENT DOCUMENTS

| | | | | |
|---|---|---|---|---|
| 2,740,239 A | | 4/1956 | Ball et al. | 51/185 |
| 3,861,892 A | | 1/1975 | Wisdom, Jr. et al. | 51/295 |
| 4,622,783 A | * | 11/1986 | Konig et al. | 51/376 |
| 4,712,289 A | | 12/1987 | Stamm et al. | |
| 5,222,331 A | * | 6/1993 | Manor et al. | 51/392 |
| 5,443,604 A | * | 8/1995 | Stowell | 51/307 |
| 5,725,423 A | * | 3/1998 | Barry et al. | 451/539 |

FOREIGN PATENT DOCUMENTS

| | | | |
|---|---|---|---|
| DE | 85 007 | 9/1970 | B24D/31/30 |
| DE | 34 30 856 C2 | 8/1984 | B24B/19/26 |
| DE | 37 90 060 C2 | 2/1987 | B24D/11/00 |
| DE | 295 05 847.1 | 4/1995 | B24D/11/00 |
| EP | 0 738 562 A2 | 12/1995 | B24D/11/02 |

OTHER PUBLICATIONS

European Search Report; EP 99 11 5933, Feb. 2, 2000, 3 pp.
Deutsches Patent– und Markenamt; Mar. 15, 1999; 198 43 266.6; Hobel.
Patentschrift 85 007; Oct. 17, 1970; Prüfstoff.

* cited by examiner

*Primary Examiner*—William P. Watkins, III

(57) ABSTRACT

A canvas abrasive material has a coating of resin and abrasive grains on a woven fabric layer, wherein the crossing places of the yarns form grinding places and free places that are distributed in a grid form over the surface of the abrasive material. A VELCRO-type clinging layer on the abrasive material facilitates manipulation.

9 Claims, 1 Drawing Sheet

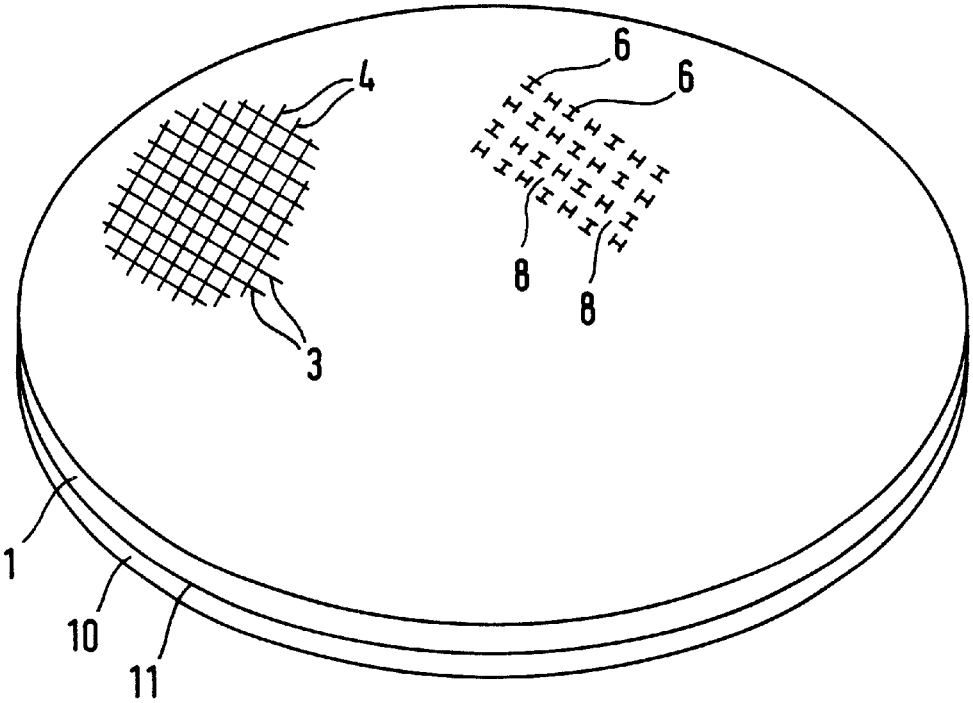
Fig. 1
Fig. 2
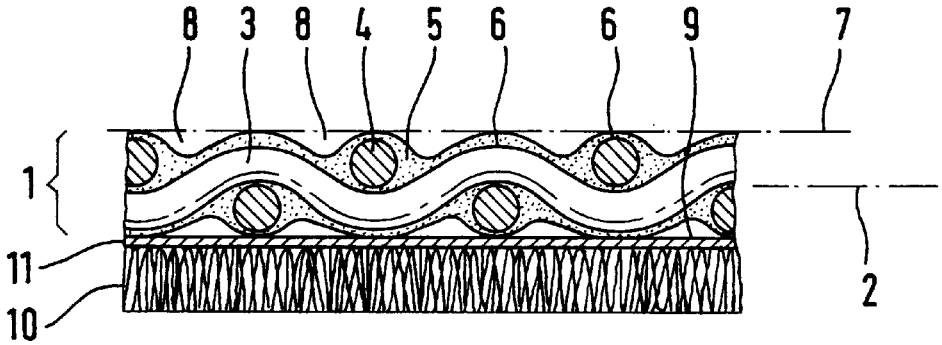

CANVAS ABRASIVE MATERIAL AND GRINDING PROCESS

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

The invention relates to canvas abrasive material and to a process, for the after-treatment of cathodically lacquered surfaces in which the abrasive canvas material is used.

In passenger car manufacture, body sheets are cathodically dip-coated (electro-coating), a base lacquer coat of up to 30 $\mu$m thickness being produced. The base lacquer has a certain roughness, to which a further lacquer layer, the so-called filler (primer) adheres well. However, peaks of roughness can occur which stand out beyond the applied primer and are therefore undesired. Such projecting roughness peaks are usually removed by grinding before the application of the primer.

SUMMARY OF THE INVENTION

The invention has as its object to provide canvas abrasive material that is particularly suitable for the after-treatment of cathodically lacquered surfaces before the application of primer.

The canvas abrasive material comprises a woven fabric layer with yarns woven in a lattice form and provided with a coating of resin and abrasive grains, giving sufficient stiffness with enough flexibility to conform to the surfaces to be ground. The coated lattice elements form crossing points that determine the grinding plane of the abrasive material; the loading with abrasive grains is thus placed in a grid-like pattern. In order to conveniently hold the canvas abrasive material on a VELCRO-type hand pad or on a grinding disk, a layer of VELCRO-type fabric is applied to the side of the fabric layer opposed to the grinding plane.

The grinding places distributed in a grid pattern form islands in the grinding plane that are respectively surrounded by "free places" in which the abrasive grains have no effect, since they are set back from the grinding plane. The free places to some extent form, in the grinding plane, gaps into which the roughness peaks of the base lacquer can penetrate, so that they can be caught laterally by the island-form grinding places and struck away ("beheaded"). In this way it is possible to chop the top off only the roughness peaks, without affecting the fine base roughness of the surface.

The thickness of the cathodically applied base lacquer is not always uniform, that is, there are also regions with too thick a lacquer layer. The canvas abrasive material according to the invention is also suitable for processing such densified lacquer layers; that is, to reduce the thickness while producing a fine base roughness that about corresponds to the base roughness of the rest of the cathodically dip coated surface.

BRIEF DESCRIPTION OF PREFERRED EMBODIMENTS

Further details will be described with reference to the drawings, in which

FIG. 1 shows a perspective diagram of a canvas grinding disk, and

FIG. 2 shows an enlarged detail thereof.

DETAILED DESCRIPTION OF PREFERRED EMBODIMENTS

A woven fabric layer 1 is cut to a circular shape in order to form a disk, the middle plane of which is denoted as the layer plane 2. Synthetic yarns or natural yarns 3, 4 are woven together into a lattice and extend partially above and below the layer plane 2. The lattice has been impregnated with resin that has abrasive grains added to it, so that a coating 5 is formed over and between the fabric yarns 3, 4. After hardening of the resin, the disk combines a sufficient stiffness in the layer plane 2 with enough flexibility to conform to the surfaces to be ground; that is, the disk always returns to its original position after being deformed in a working process.

The fabric yarns 3, 4 form lattice elements whose crossing places 6 lie in a plane 7 which represents the grinding plane. The crossing places 6 form a grid pattern and are surrounded by free places 8, at which the abrasive grains do not come into action.

A VELCRO-type velour layer 10 is applied, for example, with waterproof adhesive, to the side 9 opposed to the grinding plane 7. Manipulation of the grinding disk is improved, since it can be fixed to a VELCRO-type hand pad or grinding plate by simple apposition.

The size of the grinding disk and the grain size of the abrasive medium are chosen according to the purpose of application. Grinding disks of interest usually have a diameter between 75 and 203 mm. Other geometric shapes with other dimensions can also be used, so that the term, canvas abrasive material, is generally used. For the after-treatment of cathodically dip-coated surfaces of car body sheets, a grain size in the region of P180–P1000 is preferred. The grinding disk can however also have a grinding medium above P1000 for finer surfaces. Alox (aluminum oxide) is preferred as the grinding medium for grinding car body sheets, since the fine roughness that is produced is particularly suitable for the subsequent application of primer. For other applications, however, other grinding media can also be used, for example silicon carbide (sica), which produces a sharper abrasion. Alternatively, a finer grain of sica can be used (in comparison with alox), in order to grind car body sheets.

A preferred process for applying the new canvas grinding material consists of the after-treatment of cathodically dip-coated surfaces of car body sheets. The procedure is as follows.

The canvas grinding disk or the canvas abrasive material is uniformly guided over the whole lacquered surface, so that roughnesses of the lacquered surface that stand above a desired level get into the free places 8 of the grinding disk and are ground away ("beheaded") by the abrasive places 6. After grinding over the surface, a lacquered surface with a fine roughness remains. The surface then is wiped over with a lint-free dust catching cloth to remove the resulting dust from the lacquered surface. The operator carrying out the work inspects the treated surface for irregularities, particularly thickened regions of the base lacquer. The operator guides the grinding disk over such thickened regions to reduce the layer thickness. The grid-like distribution of the abrasive places 6 on the grinding disk leads to a corresponding base roughness of the ground regions, as is desired. The progress of the work is again observed after the obscuring dust has been wiped off.

Canvas abrasive material with fine grain size (e.g., in the range of P500–P1000) also can be used for grinding primer lacquer coats. Abrasive material that has been used up in the processing of cathodic dip-coating can be re-used on the primer layer, for the same purpose.

I claim:

1. A process comprising using a canvas grinding article for grinding of cathodically lacquered surfaces before applying of a primer in a dry operation step by hand, the lacquered surfaces having a predetermined basic roughness and roughness peaks extending over an intended lacquer layer, the canvas grinding article comprising:

a woven fabric layer defining a layer plane and including crossing yarns;

a coating of resin and abrasive grains made up to confer to said woven fabric layer a sufficient stiffness combined with enough flexibility to conform to a surface to be ground when there is hand pressure by a hand pad;

the crossings of said crossing yams defining a grinding plane of the abrasive article; said abrasive grain being distributed over said grinding plane and fixed thereto island-like or in a grid pattern leaving gaps or free spaces without effective abrasive grain, said gaps or free spaces being arranged in a recessed plane relative to said grinding plane and being dimensioned and distributed to accommodate roughness peaks of the lacquered surface to be worked upon so that such roughness peaks of the lacquered surface to be worked upon can be sized from the side and chopped by said abrasive grain in said grinding plane without impairing the basic roughness of the lacquered surface;

a layer of hook or loop material being provided on said woven fabric layer on a side opposite to that of said grinding plane and adapted to be joined to a hook and loop fastener hand pad so as to facilitate, uniformly guiding the canvas grinding article across the lacquered surface to be worked upon.

2. Use of the canvas abrasive article according to claim 1, in which said abrasive grains have a particle size in the region of approximately P180–P1000.

3. Use of the canvas abrasive article according to claim 1, in which said abrasive grains have a particle size above approximately P1000.

4. Use of the canvas abrasive article according to claim 1, in which said abrasive grains comprise an aluminum oxide.

5. Use of the canvas abrasive article according to claim 1, in which said abrasive grains comprise a silicon carbide.

6. Use of the canvas abrasive article according to claim 1, in which said canvas abrasive article has a disk shape with a diameter in a range of about 75–203 mm.

7. A method for treating coated surfaces having projecting points over a basic roughness and uneven regions with thickened coatings, the method being carried out for preparing a further lacquer application, comprising the steps of:

(a) providing canvas abrasive material defining a grid pattern in a grinding plane having a pattern of gaps therein;

(b) sliding said canvas abrasive material evenly across the total coated surface in a dry operation so as to cause the projecting points of said basic roughness to enter into said gaps of the canvas abrasive material;

(c) seizing said projecting points over said basic roughness by said canvas abrasive material laterally and cutting away said projecting points over said basic roughness;

(d) taking up dust resulting from step (c) with a lint-free cloth;

(e) inspecting said coated surface and repeating steps (b) through (d), if desired;

(f) inspecting the coated surface treated in steps (b) through (e) for said uneven regions having thickened coatings thereon;

(g) removing material from the thickened coating region, if any, until same has a desired uniformity and fine roughness;

(h) removing dust from said coated surface treated by said lint-free cloth.

8. The method of claim 7, wherein said coated surface is a cathodically dip-coated surface of a car body member.

9. The method of claim 1, further comprising the steps of (i) applying a primer laquer upon the surface treated in step (g)

(j) applying the steps of (a) through (g) to the primer laquer.

* * * * *